United States Patent [19]

Paton et al.

[11] 4,004,076

[45] Jan. 18, 1977

[54] NONCONSUMABLE ELECTRODE FOR MELTING METALS AND ALLOYS

[76] Inventors: Boris Evgenievich Paton, ulitsa Kotsjubinskogo, 9, kv. 21; Viktor Iosifovich Lakomsky, ulitsa Anri Barbjusa, 22/26, kv. 119; Vladimir Nikolaevich Kostyakov, ulitsa Zhelyabova, 10, kv. 56; Vitaly Mikhailovich Shian, ulitsa Borodyanskaya, 12, kv. 58; Alfred Iosifovich Bukalo, ulitsa P. Zaporozhtsa, 8/2, kv. 69; Jury Vladimirovich Lisovoi, ulitsa Sovetskaya, 24; Valentin Petrovich Domrachev, ulitsa Gvardeiskaya, 10, kv. 1, all of Kiev, U.S.S.R.

[22] Filed: June 6, 1975

[21] Appl. No.: 584,495

[52] U.S. Cl. ..... 13/18

[51] Int. Cl.[2] ..... H05B 7/08

[58] Field of Search ..... 13/18, 9, 11

[56] References Cited

UNITED STATES PATENTS

| | | | |
|---|---|---|---|
| 3,395,240 | 7/1968 | Kemeny et al. | 13/9 X |
| 3,812,620 | 5/1974 | Titus | 13/18 X |

*Primary Examiner*—R. N. Envall, Jr.

[57] ABSTRACT

Nonconsumable electrode for melting metals and alloys, comprising a housing with a hollow fluid-cooled tip. On one of the tip's side-walls, on the side of the cavity, there is at least one threaded groove. This side wall with the threaded groove on it serves as a means for the rotation of the arc which is actuated between the tip and a metal or alloy to be melted.

2 Claims, 4 Drawing Figures

NONCONSUMABLE ELECTRODE FOR MELTING METALS AND ALLOYS

This invention relates to sources of heat, and, more particularly, to nonconsumable electrodes for melting metals and alloys, generally employed in electrometallurgical installations for melting metals and alloys, and also in installations for the partial melting or building up metal slabs. The proposed electrode can also be used for melting metals and alloys when a lump charge is fed into vacuum furnaces equipped either with fluid-cooled crystallizers or crucibles, and in ceramic-lined electric arc furnaces.

There are known fluid-cooled electrodes used for melting metals and alloys, that comprise a housing and a copper tip. In the course of melting a powerful electric arc is produced between the electrode's copper tip and the metal to be melted. As a rule, the electrode is set in the furnace at a definite angle to the surface of the electrolyzer bath. The electrode's high durability with high arc current is ensured by setting it into rotation around its axis at a speed of up to 250 r.p.m. As the electrode rotates, the actuated spot of its arc moves along the surface of the fluid-cooled copper tip, and this ensures its relatively insignificant wear.

As a rule, the melt in the furnace is effected by using an arc of opposite polarity, for which purpose it is the positive pole of the power source that is connected to the nonconsumable electrode. Such an electrode design makes it possible to melt metals and alloys out of lump charges, and to abandon the use of consumable electrodes.

The above-described nonconsumable fluid-cooled electrode has a complex structure because of the mobility of the electrode's current and fluid supply means. Besides, special drive means have to be provided for the electrode's rotation, which considerably complicates the design of such a melting unit as a whole. The reliability of the melting process in using such electrodes is determined by the workability of the above-mentioned components.

One of the known nonconsumable fluid-cooled electrodes used for melting metals and alloys is an electrode in which permanent magnets serve for the rotation of its arc, the magnets being disposed in the fluid-cooled cavity of the electrode's copper tip. In the process of melting an electric arc of considerable magnitude is actuated between the butt-end of the tip and the metal to be melted, the arc's rotation being effected by arranging the permanent magnets' positive poles at definite points within the cavity of the electrode's tip. During the arc's rotation its actuated spot is made to move along the butt-end of the copper tip, so the tip is subjected to insignificant erosion. As a rule, the melting is carried out by using an arc of opposite polarity, which makes it possible, to a satisfactory degree, to preserve the copper tip from undue wear even at reduced arc rotation speeds.

The above-described nonconsumable fluid-cooled electrode has a complicated design, which applies primarily to is copper tip that has to have a special configuration. The operational reliability of such an electrode is attained through the installation of powerful magnets. This factor calls for increased dimensions of the electrode, which, in consequence, reduces its thermal efficiency.

Another known type of nonconsumable electrode for melting metals and alloys, comprising a housing and a tip, is an electrode wherein the means for the rotation of the arc, which is actuated between the tip and the metals and alloys that are to be melted, are arranged within the tip's cooled cavity and made in the form of a coil.

To produce a directional flow of the cooling agent through the fluid channels in the electrode and the tip, the arc's rotation means are placed in a special casing made of a nonmagnetic material. Separate power supply sources are used for the rotation of the arc and for the electrode. A source of low-voltage current is used for the rotation of the arc in order to reduce the danger of an insulation breakdown in this means sited in the tip's cooled cavity. In the course of melting, the arc rotation means produce a powerful magnetic field which is superimposed on the magnetic field of the arc and causes its rotation and the movement of the arc's actuated spot along the butt-end of the copper tip.

This imparts a high degree of erosion resistance to the tip even under conditions when there is considerable heat generation from the actuated spot of the arc. Control of the arc's speed of rotation is effected by changing the current fed from the power source to the arc rotation means. Melting with the aid of such an electrode can be carried out by employing either an arc of straight polarity or an arc of reverse polarity. However, when employing an arc of straight polarity, it is necessary to rotate the arc at a speed of over 1,000 meters per second, which calls for powerful magnetic fields, and, understandably, the supply of high currents to the arc rotating means.

Just as all the other electrodes described above, the electrode under review has a complex design owing to the disposition of the arc rotation means in the fluid-cooled cavity of the electrode, right in its tip. Besides, the need to have special powerful low-voltage sources to operate the arc rotation means calls for additional space to install them and, naturally, raises the electrode's overall production cost.

The arrangement of the arc rotation means in the fluid-cooled cavity does not ensure the electrode's high reliability in operation because of the danger of an insulation breakdown and even of a furnace explosion, for example, in melting titanium.

The object of the present invention is to construct a nonconsumable electrode for melting metals and alloys that would be of a simplified design.

Another object of the present invention is to raise the reliability and efficiency of the electrode.

The foregoing object is attained by providing a nonconsumable electrode for melting metals and alloys, composed of a housing with a tip member, in the fluid-cooled section of which there are sited the means for the rotation of the arc, which is actuated between said tip and the metals and alloys to be melted. According to this invention, one of the tip's sidewalls, on which there is at least one threaded groove, serves as the means for the rotation of the arc.

It is advisable to use as the arc's rotational means not only the one sidewall of the tip, but its other sidewall as well, with at least one threaded groove provided on it on the side of the cooled cavity.

The precisely fulfilled construction of the proposed nonconsumable electrode for melting metals and alloys ensures its high performance and long service life. Moreover, the proposed electrode has a simpler design.

The provision of the threaded groove on the tip's sidewall enables the sidewall itself to produce a longitudinal component of magnetic arc field, which removes the need to employ a coil that would otherwise require a separate low-voltage source as the means for producing an outer magnetic field.

Other objects and advantages of the present invention will become more apparent from the following detailed description of preferred embodiments thereof taken in connection with the attached drawings wherein.

Figure 1:
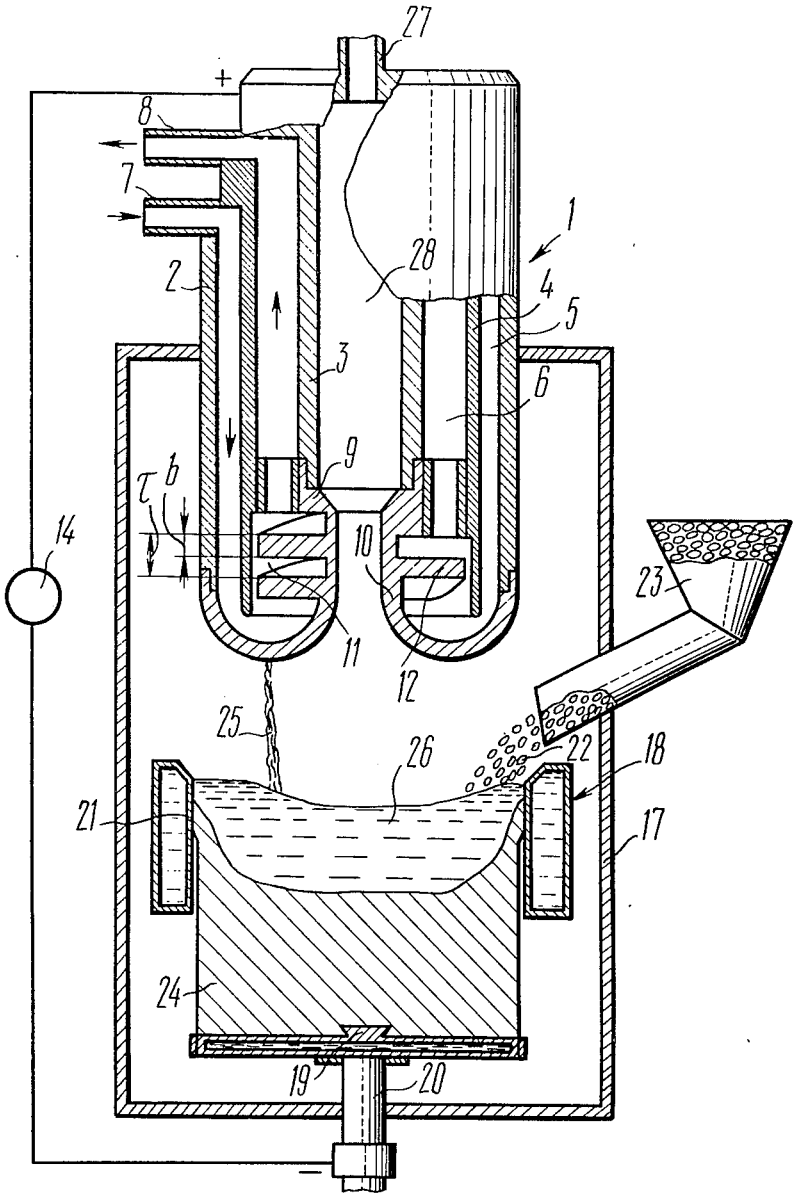
FIG. 1 is a view of a vacuum-arc furnace for melting slabs of metal from a lump charge with the use of the proposed non-consumable electrode.

Referring now to the attached drawings, an electrode 1 (FIG. 1) for melting metals and alloys comprises a housing constructed of two coaxially positioned steel tubes, an outer tube 2 and an inner tube 3. Arranged in the housing of the electrode 1, formed of the outer and inner tubes 2 and 3, is a copper tube 4 which forms channels 5 and 6 for the flow of the cooling agent fed through a branch pipe 7 and the channel 5 and evacuated through a branch pipe 8 and the channel 6.

In the lower portion of the electrode's housing, threadedly secured to the copper tube 4, is a copper tip 9, copper being a material with a high heat conduction and a low specific resistance. In this case, the copper tube 4 also serves as the current lead to the tip 9 of the electrode 1. On one of sidewalls 10 of the tip 9, on the side of the channel 6, is a one-start threaded groove 11 arranged in such a way that a shoulder 12 is formed on the sidewall 10. The sidewall 10 of the tip 9 serves as an arc rotating means.

When current passes through the sidewall 10 of the tip 9 it produces a radial arc magnetic field directed at a tangent to the coil of the threaded groove 11, which reduces the longitudinal component of the arc magnetic field, caused by the rotating means. This is why the thickness $b$ of shoulders 12 should be equal to half of the pitch $\tau$ of the one-start threaded groove 11.

Figure 2:
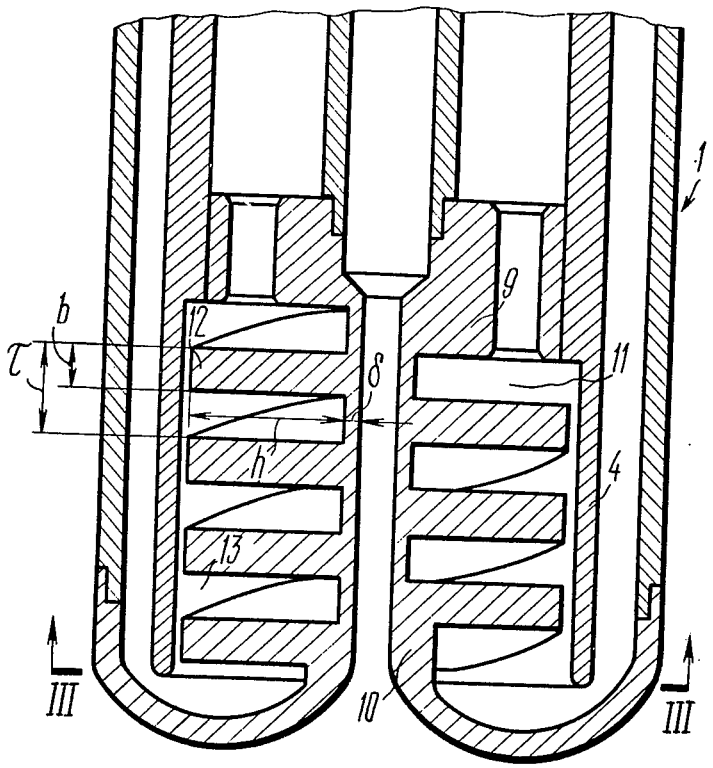
FIG. 2 is an elevation view of an alternate embodiment of the proposed nonconsumable electrode with an arc rotation means in the form of a double-start threaded groove on the sidewall of the tip.
Figure 3:
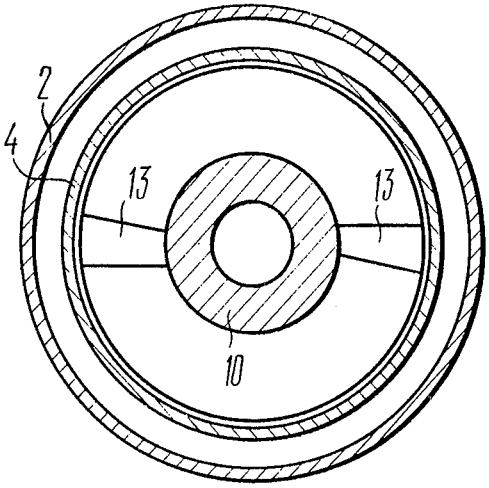
FIG. 3 is a section taken along the line III-III of FIG. 2.

In the case when a multiple-start threaded groove is employed with $n$ threads, $n$ in this case being equal to 2, the thickness $b$ of the shoulder 12 (FIG. 2) should be equal to the pitch $\tau$ of any of the grooves divided by double the number of starts in the grooves 11 (FIG. 3) and 13.

Generally, the thickness $b$ of the shoulder is selected to meet the condition:

$$b = \tau/2n$$

The depth $h$ (FIG. 2) of the shoulder 12 for the above thickness and the thickness $\sigma$ of the sidewall 10 of the tip 9 are selected so as to pass the maximum current applied to the electrode 1 from a power source 14 (FIG. 1).

In accordance with manufacturing requirements, when using various methods of melting, the threaded groove 11 on the sidewall 10 of the tip 9 is made in different ways. Thus, for example, the arrangement of two threaded grooves on one sidewall ensures a more even distribution of the intensity of the magnetic field in close proximity to the butt-end of the tip 9.

Figure 4:
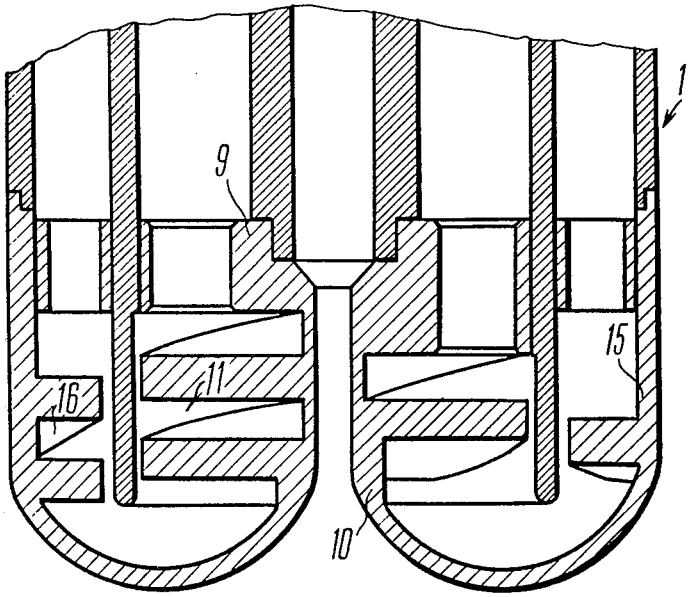
FIG. 4 is an elevation view of a third embodiment of the proposed electrode with the arc rotation means made in the form of threaded grooves on both sidewalls of the tip.

There is also a third embodiment in which both sidewalls 10 and 15 (FIG. 4); each having a threaded groove on them, 11 and 16 respectively, serve as rotating means. In this case the ratio between the dimensions of the threaded grooves 11 and 16 remains as indicated above.

In employing the proposed electrode for melting, the electrode 1 is arranged in the upper portion of a melting chamber 17 (FIG. 1) of a vacuum arc furnace coaxially with a fluid-cooled crystallizer 18. The crystallizer 18 has a fluid-cooled bottom plate 19 which is moved by a rod 20. The power to the electrode 1 and the rod 20 is supplied from the source 14. Walls 21 of a crystallizer 18 and the bottom plate 19 in the initial stage of melting form a fluid-cooled melting crucible, into which there is loaded a lump charge 22 from a hopper 23. A finished slab 24 is removed with the aid of the rod 20 and lowered together with the bottom plate 19.

In the course of melting, an arc 25 is produced between the butt-end of the tip 9 and the lump charge, and subsequently between the tip 9 and the surface of a bath 26. To stabilize the arcing of the arc 25 and carry out metallurgical processes, inert or active gas is fed into the arc zone through a branch pipe 27 and a cavity 28 of the electrode 1.

The process of melting in a vacuum arc furnace with the aid of the proposed nonconsumable electrode is carried out in the following manner.

Into the fluid-cooled crystallizer 18, located within the melting chamber 17, there is loaded the lump charge 22, fed from the hopper 23. The fluid-cooled bottom plate 19 and the sidewalls 21 of the crystallizer 18 form a fluid-cooled melting crucible. After the loading of a definite amount of the lump charge 22, the nonconsumable electrode, arranged above the melting chamber, coaxially with the crystallizer 18, is lowered to a distance determined by the arcing conditions of the arc 25. After that, power is supplied from the source 14 to the electrode 1 and to bottom plate 19 through the rod 20. With the aid of known methods, such, for example, as a high-frequency discharge which is used in the embodiment under review, an electric arc is actuated between the butt-end of the tip 9 of the electrode 1 and the lump charge 22 that is to be melted. With the actuation of arc 25, current passes through the edges of the shoulders 12 formed by the threaded groove 11 on the sidewall 10 of the tip 9 and through the sidewall 10 itself.

The current of the arc 25, in passing through the shoulders 12 on the sidewall 10 of the tip 9, produces a longitudinal component of the arc magnetic field. Since the arc 25 itself produces a transverse magnetic field, whose magnetic induction vector is directed at a tangent to the magnetic lines of force, the superimposition of the longitudinal magnetic field, produced by the threaded groove 11, causes the arc to rotate. As this takes place, the actuated spot of the arc at its connection to the butt-end of the tip 9 moves along this butt-end at a preset speed. In this way, the presence of the threaded groove 11 on the sidewall 10 of the tip 9 makes it possible to produce two arc magnetic field components whose intersection causes rotation of the arc 25.

The process of melting can be carried out by using an arc of either direct or reverse polarity so that the number of ampere-turns used in the means for the rotating the arc produced by the threaded groove 11 is not less than the number of ampereturns of the arc 25.

An increase in the magnetic induction of the longitudinal component of the magnetic field of the arc 25 may be attained only by increasing the depth of the threaded groove 11, and, correspondingly, by reducing the thickness $\sigma$ (FIG. 2) of the sidewall 10 of the tip 9 at the site of the threaded groove 11.

As the melting of the lump charge 22 (FIG. 1) is completed, the bottom plate 19 is lowered with the aid of the rod 20 and the slab 24 is removed. During this process, the lump charge 22 is continually loaded, in definite portions, into the crystallyzer 18 from the hopper 23.

In order to stabilize the arcing of the arc 25, inert or active gas may be fed through the branch pipe 27 and the cavity 28 of the electrode 1.

Melting may be carried out with the aid of the proposed electrode in a vacuum furnace and under excess pressure.

The arrangement of the threaded groove 16 (FIG. 4) on the other sidewall 15 of the tip 9 is made in such a way to rule out a discharge between this wall and the lump charge 22.

The proposed nonconsumable electrode for melting metals and alloys in its embodiments described above has a number of advantages over other known electrodes. These advantages include the possibility of melting metals and affecting the rotation of the arc with the arc's own current, thus excluding the need for using two power sources.

The proposed electrode is capable of long-term service because of its utilization ad the means of arc's rotation of the walls of the tip on which there arc threaded grooves intensely cooled by a cooling agent. Such a design of the sidewall of the tip makes it possible to considerably simplify the design of the nonconsumable electrode

What is claimed is:

1. A nonconsumable electrode for melting metals and alloys, comprising: a cooled housing connected to a supply source; a cooled tip having a cavity defined by inner and outer walls of said tip; said inner walls having at least one threaded groove provided on the side of said cavity, said groove serving to rotate the arc generated between said tip and the molten metal and alloy.

2. A nonconsumable electrode for melting metals and alloys, comprising: a cooled housing connected to a supplly source; a cooled tip having a cavity defined by the inner and outer walls of said tip; both said inner and said outer walls having at least one threaded groove provided on the side of said cavity; said outer and said inner walls with said grooves serving to rotate the arc generated between said tip and the molten metal and alloy.

* * * * *